United States Patent [19]

Stames

[11] Patent Number: 4,998,296

[45] Date of Patent: Mar. 12, 1991

[54] HYPOTHERMIA PROTECTION SUIT COLLAPSIBLE INTO COMPACT PACKAGE FOR STORAGE

[76] Inventor: Rebecca M. Stames, 18F Hobbes La., Rochester, N.Y. 14624

[21] Appl. No.: 442,034

[22] Filed: Nov. 28, 1989

[51] Int. Cl.[5] ..... A41D 13/00; A41D 31/02

[52] U.S. Cl. ..... 2/69.5; 2/84; 2/2

[58] Field of Search ..... 2/69, 69.5, 82, 83, 2/84, 16, DIG. 6, DIG. 7, 96, 243 B, 158, 2; D2/25, 31, 17, 28; 206/524.8

[56] References Cited

U.S. PATENT DOCUMENTS

| | | | |
|---|---|---|---|
| 299,580 | 1/1989 | Hansen | D2/25 |
| 305,575 | 1/1890 | Gordon et al. | D2/17 |
| 1,102,408 | 7/1914 | Hubner | 2/69.5 |
| 1,238,340 | 8/1917 | Robeson . | |
| 1,292,381 | 1/1919 | Milkes | 2/84 |
| 2,121,788 | 6/1938 | Daiber | 2/83 |
| 2,428,795 | 10/1947 | Frazee | 2/69.5 |
| 2,683,262 | 7/1954 | Foss | 2/69.5 |
| 2,839,757 | 6/1958 | Gianola | 2/84 |
| 2,911,649 | 10/1959 | Reulle | 2/69.5 |
| 2,967,806 | 1/1961 | Fabanich | 2/69.5 |
| 3,228,034 | 1/1966 | Grove | 2/69.5 |
| 3,299,441 | 1/1967 | Slimovitz | 2/158 |
| 3,458,966 | 8/1969 | Dunbar et al. | 206/524.8 |
| 3,695,507 | 10/1972 | Sams | 2/2 |
| 3,798,676 | 3/1974 | Shanks et al. | 2/69.5 |
| 3,849,802 | 11/1974 | Govaars | 2/84 |
| 4,023,223 | 5/1977 | Anderson et al. | 2/82 |
| 4,054,204 | 10/1977 | Keeton | 206/524.8 |
| 4,147,329 | 4/1979 | Holland | 2/82 |
| 4,383,336 | 5/1983 | Beckmann et al. | 2/158 |
| 4,465,189 | 8/1984 | Molzan | 206/524.8 |
| 4,467,477 | 8/1984 | DeGennaro | 2/84 |
| 4,507,805 | 4/1985 | Calutoiu | 2/69.5 |
| 4,532,654 | 8/1985 | Sigismonde | 2/69.5 |
| 4,577,816 | 3/1986 | Foster | 206/524.8 |
| 4,583,247 | 4/1986 | Fingerhut et al. | 2/69 |
| 4,683,593 | 8/1987 | Langley | 2/82 |
| 4,807,303 | 2/1989 | Mann et al. | 2/69 |

FOREIGN PATENT DOCUMENTS

| | | | |
|---|---|---|---|
| 1188828 | 6/1985 | Canada | 2/69.5 |
| 2475375 | 8/1981 | France | 2/69.5 |
| 1139712 | 12/1967 | United Kingdom | D2/30 |

OTHER PUBLICATIONS

Gershman, "Self-Adhering Nylon Tapes", Journal of AMA, vol. 168, No. 7, 10/18/1958.

*Primary Examiner*—William A. Cuchlinski, Jr.
*Assistant Examiner*—Alvin Wirthlin
*Attorney, Agent, or Firm*—Howard J. Greenwald

[57] ABSTRACT

A skin of a protective, compressible garment contains a top layer of nonmetallic material, a bottom layer of nonmetallic material, and a middle layer of open-cell foam material which is in contact with both the top and bottom layers. The garment contains an entry flap extending along its front, arms extending from both of its sides, and an opening across its bottom. Fasteners are provided for closing the entry flap and the opening across the garment bottom.

10 Claims, 5 Drawing Sheets

HYPOTHERMIA PROTECTION SUIT COLLAPSIBLE INTO COMPACT PACKAGE FOR STORAGE

DESCRIPTION

The present invention relates to protective apparatus and particularly to apparatus for protecting a person from hypothermia.

The invention is especially suitable for use as a hypothermia suit or garment for stranded motorists and may be used to protect the motorist against hypothermia which occurs when the body's core temperature drops below ninety-five degrees, as may occur during severe weather conditions such as a blizzard.

It is a principal feature of the present invention to provide apparatus for protecting against hypothermia which can be stored in a very compact package suitable for placement under the seat of an automobile, and yet is of sufficient size when removed from the package and put on by the user to protect the user against hypothermia.

Another feature of the invention is to provide a garment which enables the user who puts on the garment to obtain extra warmth by drawing his or her arms into the suit and clutching the knees thereby assuming a fetal position.

It is another feature of the invention to provide a hypothermia protective garment which may be fabricated inexpensively so as to provide low cost protection against hypothermia to users.

It is a still further feature of the invention to provide an improved hypothermia protection garment which can be easily entered and from which the user can extend his or her legs and/or hands when mobility or the use of hands is necessary, as for example when the user is a motorist who must exit from a car which has fallen into a roadside ditch.

Briefly described, hypothermia protection apparatus in accordance with the invention provides a body covering (a suit or garment) having a skin (the shell of the covering) made of a layer of compressible cellular material sandwiched between sheets of air-permeable material. A container is provided which has an interior volume much smaller than the volume occupied by the covering. An evacuable sheath receives the covering in folded condition. When the sheath is evacuated, the covering is collapsed and compressed into a size and shape which is receivable into the container for storage. The covering has at least one entry opening for the wearer which may be closed by strips of hook-and-loop type fastener material of the type sold under the trade name Velcro. The strips are disposed in opposed relationship on opposite sides of the entry opening for closing the covering after entry. The covering may also be provided with arms which are formed from front and back portions; the front portions overlapping to define the entry opening. Exit openings for the hands may be covered by flaps. The covering, which is generally in the form of an envelope open at the bottom, is provided along its open bottom with a flap having Velcro strips which enable the flap to close the bottom or to be held up against the back or the front of the envelope so as to allow the legs of the occupant to extend out of the envelope thereby providing the occupant with mobility. The back of the envelope may have a section, attached to or as an integral part thereof, which defines a hood. The hood may have a face flap also closed by Velcro tabs which covers the head of the occupant leaving a small opening for mouth and eyes.

The foregoing and other features and advantages of the invention, as well as a presently preferred embodiment thereof, and the best mode of presently known for practicing the invention, will become more apparent from a reading of the following description in connection with the accompanying drawings in which.

Figure 1:
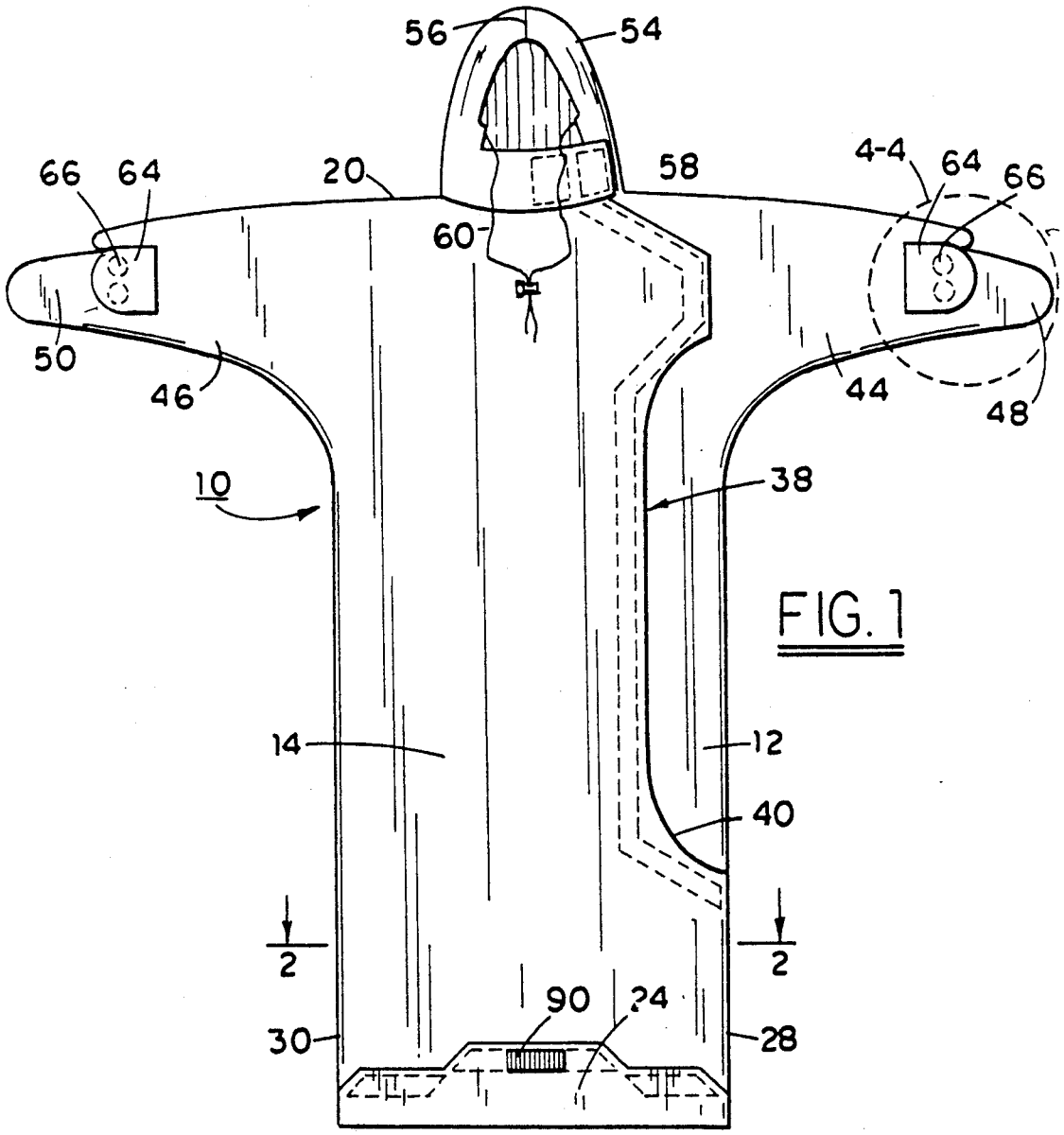
FIG. 1 is an elevational view of the front of a hypothermia protective garment embodying the invention.
Figure 2:
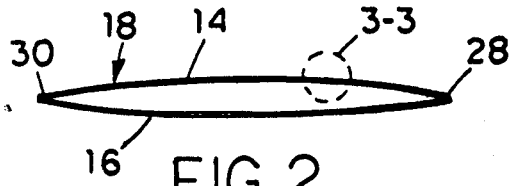
FIG. 2 is a sectional view along the line 2—2 of FIG. 1.
Figure 4:
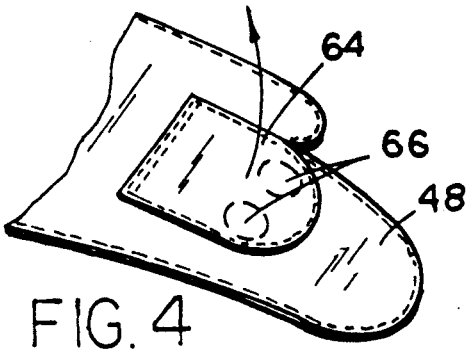
Figure 5:
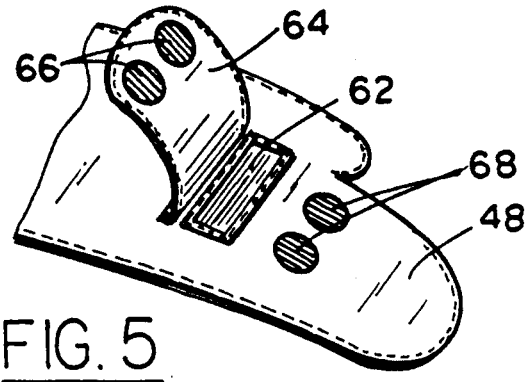
Figure 6:
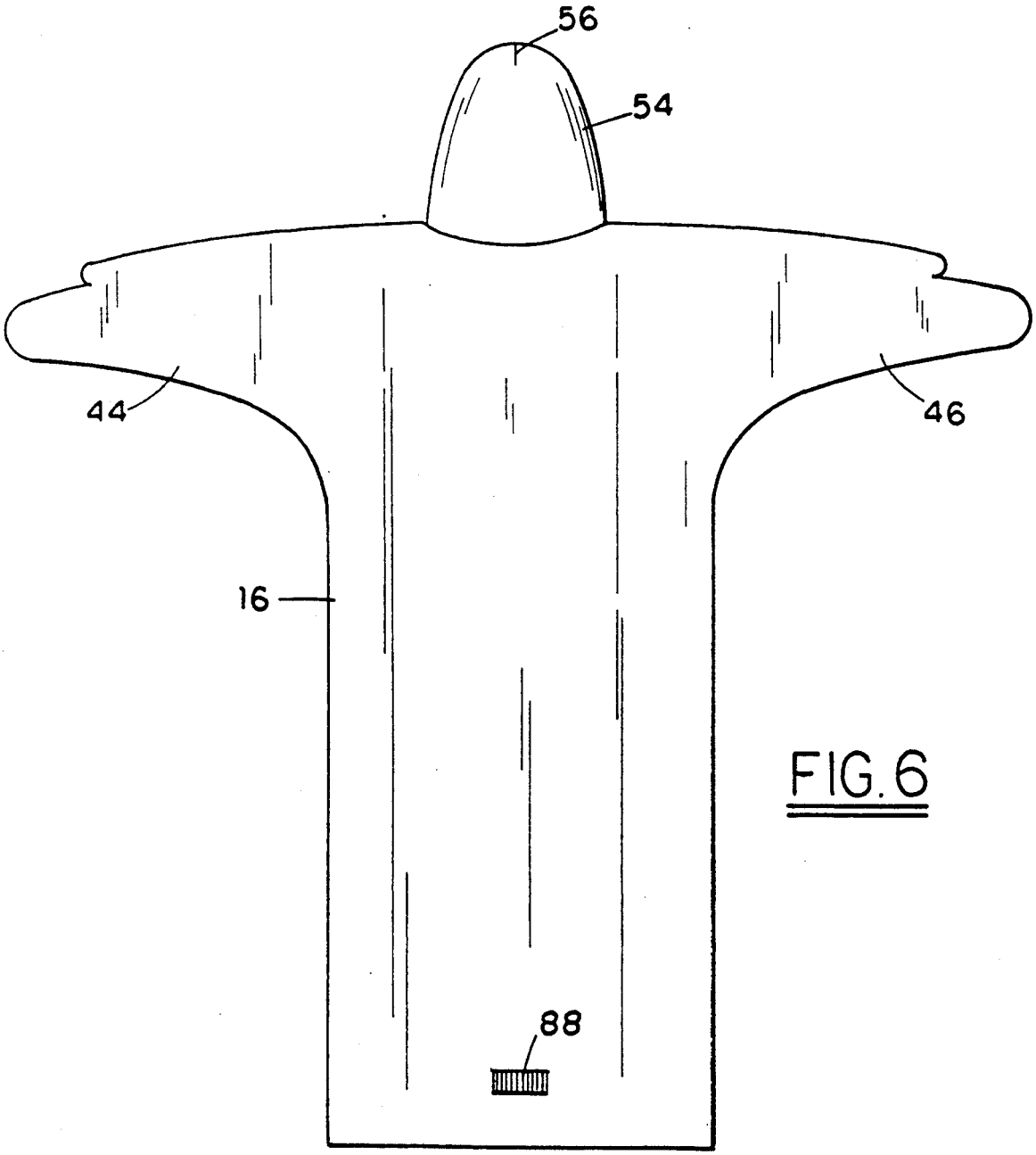
Figure 7:
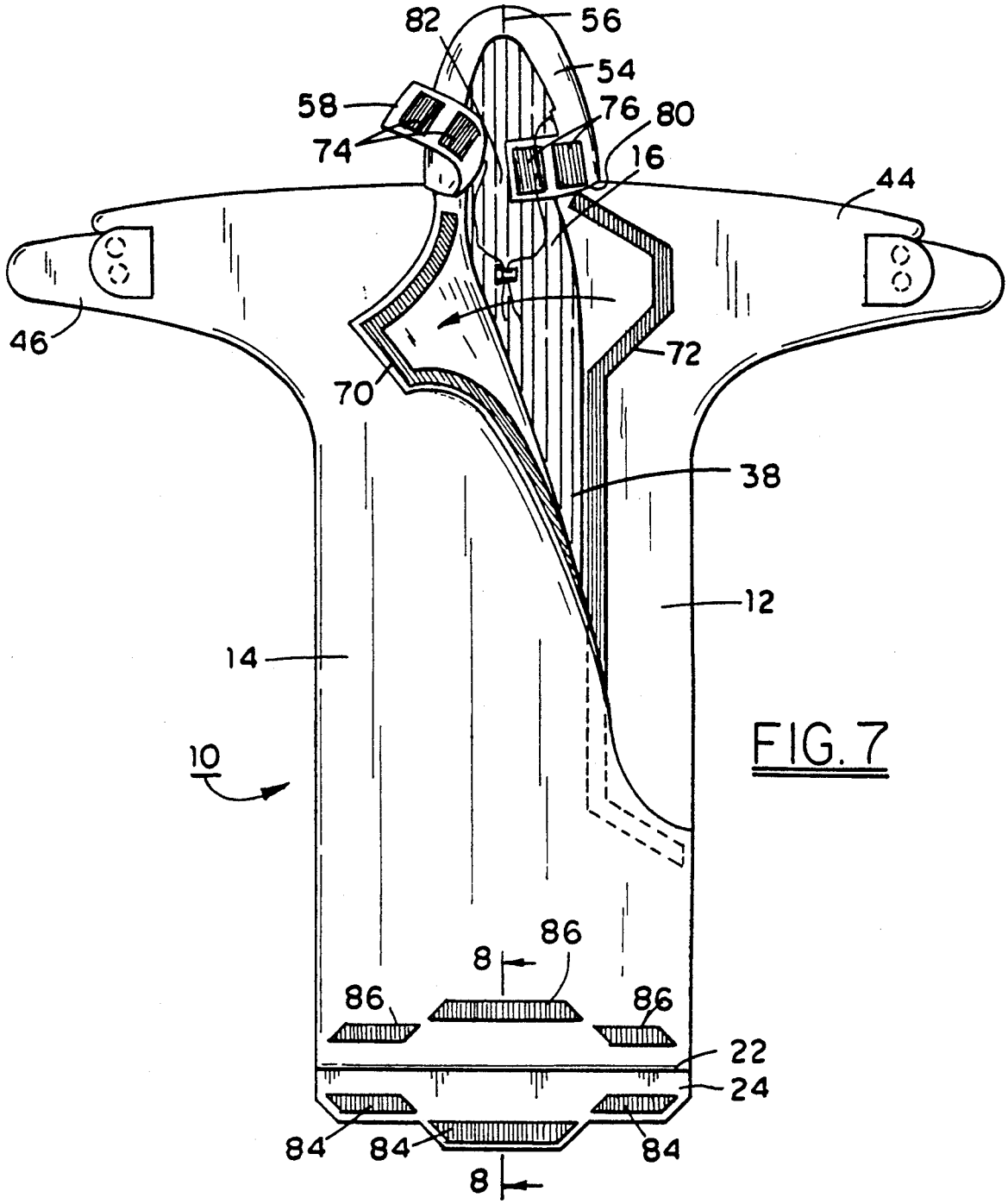
Figure 8:
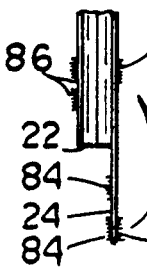
Figure 9:
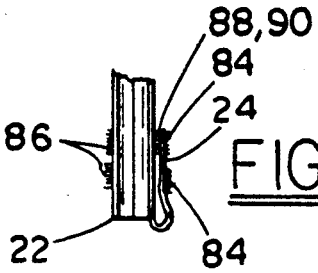
Figure 10:
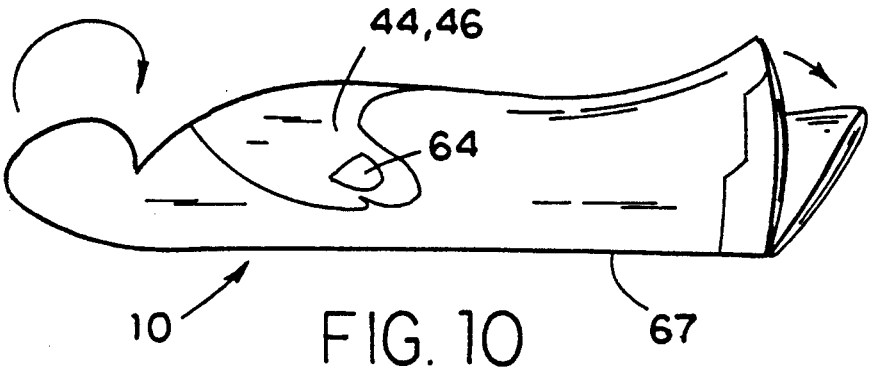
Figure 11:
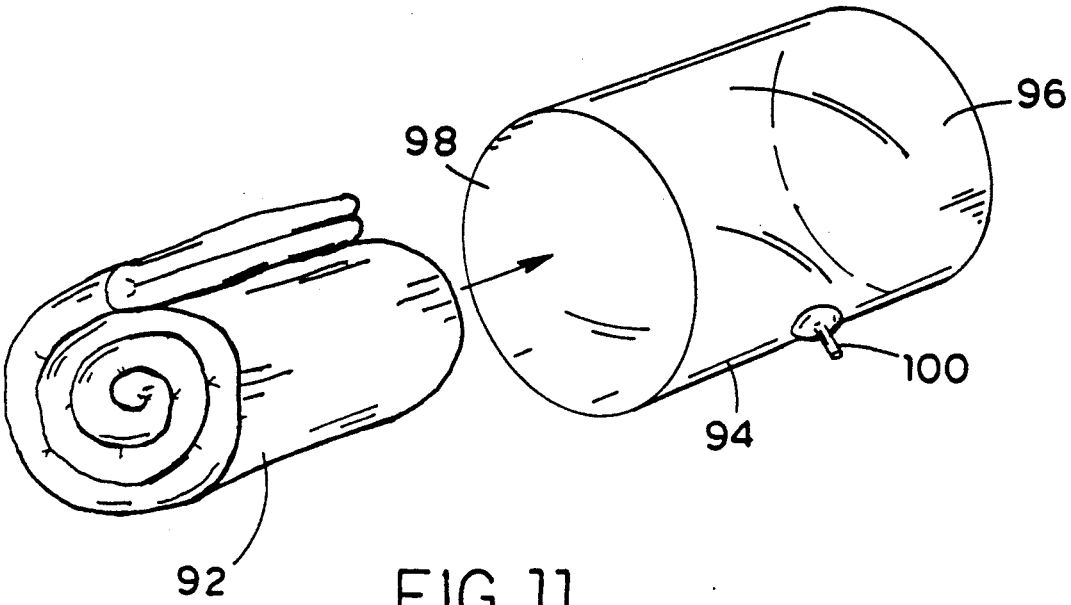
Figure 12:
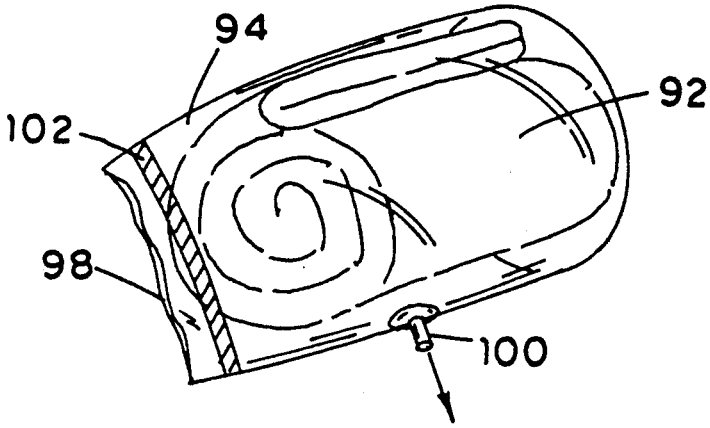
Figure 13:
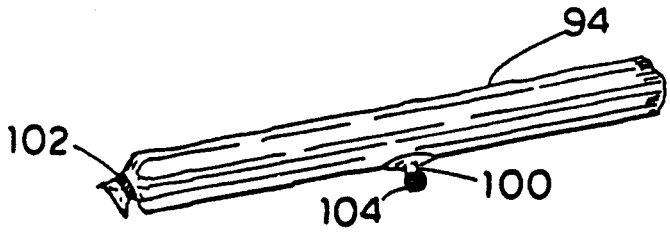
Figure 14:
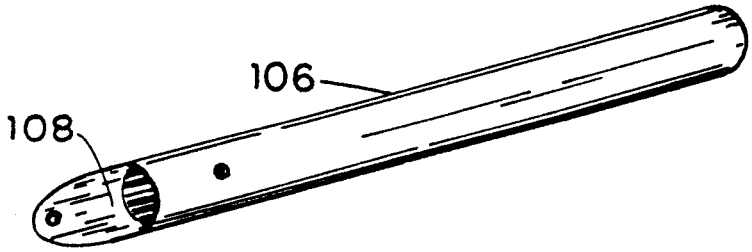
Figure 15:
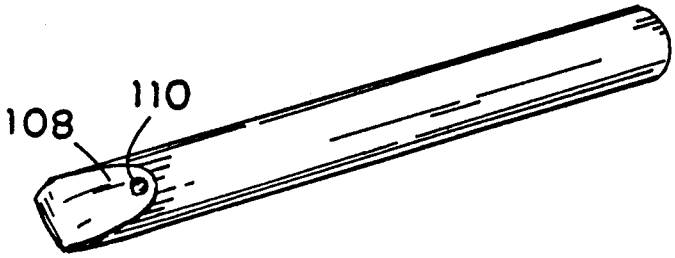

FIGS. 4 and 5 are perspective fragmentary views of the hand or glove portion of the arms of the garment shown in FIG. 1, taken generally along the line 4—4 in FIG. 1, with a flap covering a hand exit slot shown closed and open, respectively in FIGS. 4 and 5;

FIG. 6 an elevational view of the back of the garment shown in FIG. 1;

FIG. 7 is a view similar to FIG. 1 with the entry flap, face flap and bottom flap in open position;

FIGS. 8 and 9 are fragmentary sectional views, taken generally along the line 8—8 in FIG. 7, showing the bottom flap down and folded upwardly and attached to the back of the garment, respectively;

FIG. 10 is a perspective view showing the garment in the process of being folded into rolled up condition;

FIG. 11 is a perspective view showing the rolled-up folded garment being placed in an evacuable sheath for compression;

FIG. 12 is a perspective view illustrating the sheath sealed and being evacuated which compresses the garment;

FIG. 13 is a perspective view showing the collapsed, compressed garment in the sheath; and FIGS. 14 and 15 are perspective views showing the container for the compressed garment (contained in its sheath) with an end flap of the container open and closed respectively.

Figure 3:
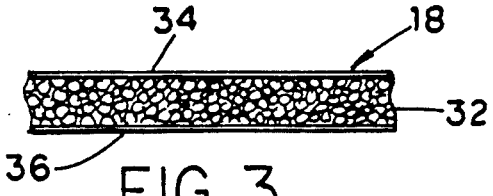
FIG. 3 is an enlarged view of the skin of the garment along the line 3—3 in FIG. 2.

Referring more particularly to FIGS. 1-9 of the drawings, there is shown a hypothermia protective garment or suit 10 which may be made of a pair of front pieces 12 and 14 and a back piece 16 all pieces are made of a skin or shell 18 which is shown in FIG. 3. The garment has a top 20, a bottom 22 which is shown closed by a flap 24 in FIG. 1, and with the flap 24 open in FIG. 7. The body has side edges 28 and 30 which are formed when the front and back pieces are attached as by sewing, either directly through the skin providing the front and back pieces or using piping (not shown) or by attaching at the edges with cement.

The skin 18 has a core 32 of compressible cellular material, preferably open-cell polyurethane foam. In a preferred embodiment of the material the foam used was one pound per square foot density. The foam core 32 is sandwiched between sheets 34 and 36 of air-permeable material. The material which is preferably used is spun-bonded olefin which is sold under the trade name Tyvek by the DuPont Company of Wilmington, Del. This material is air-permeable. In other words, it breathes. The material, however, is puncture-proof as well as moisture-resistant. The skins may be connected in spots by glue, but such connection is not necessary since when the front and back sections are sewn together the sheets 34 and 36 are connected to the core 32.

The front pieces 12 and 14 overlap to define an entry opening or flap 38 which extends from the top 20 partway down to the bottom. This opening is defined by a cutaway portion of the piece 14. The front piece 14 is attached as by sewing or cementing or heat sealing along the edge 30 to the back panel. Sewing or cementing is also used between the cutaway portion 40 of the front piece 14 and the bottom 22. The back and front pieces may be cut with a pattern which defines arms 44 and 46 which taper outwardly. These arms form sleeves having hand or glove sections 48 and 50 at the ends thereof. The front pieces 12 and 14 overly the back piece in the arms and are attached thereto by sewing or cementing or heat sealing along the edges.

The back piece 16 may have a hood section 54 which is sewn along a seam 56 at the top of the hood. The hood also has a face flap 58 and may have piping or a sewn channel to define an opening for a drawstring 60. One of the hand sections of the arms (FIGS. 4 and 5), the other hand section 50 being identical in design, is provided in the front piece portion thereof with a rectangular slot 62. This slot may be sewn around its edges so as to secure the layers 32, 34 and 36 of the skin. A flap 64 of the same skin material covers the slot 62. Pairs 66 and 68 of tabs of hook-and-loop fastener material of the type sold under the trade name Velcro are disposed on the tab 64 and also on the front side of the hand section 48 of the arm. By spacing the tabs apart as shown, a finger of the hand may be placed between the tabs to assist in opening the flap so that the entire hand may easily exit through the slot 62.

The main entry flap 38 is also lined along the edges by overlapping opposed strips 70 and 72 of Velcro. Once the user enters the suit, the closure means provided by the strips 70 and 72 is closed so that the user is sealed in the envelope defined by the back 16 and the front pieces 12 and 14. Pairs of Velcro tabs 74 and 76 are placed on the face flap 58 and on an underlying portion at the base of the hood 54 for closing the face flap thereby leaving only a small opening which exposes mostly only the eyes and nose of the occupant. A sewn seam 80 is provided between the base part of the hood 82 and the top of the front piece 12. Rather than being integral with the back 16, the hood may be separate and sewn to the back along the top and also along the seam 80.

The bottom flap 24 has three strips of Velcro 84 which cooperate with and attach to corresponding strips 86. These strips are attached as by sewing, which may be used to attach the other Velcro strips and tabs, to the front piece 14. Another tab of Velcro 88 is attached to the back 16 near the bottom 22 and cooperates with a tab 90 of Velcro at the lower end of the flap. Thus, by attaching the tabs 88 and 90 as shown in FIG. 9 the flap 24 may be held up and out of the way of the legs which extend through the bottom to provide mobility to the occupant of the garment 10. It will be appreciated that the flap 24 may be made part of the front piece 14 rather than the back piece 16 and the same results obtained when the tabs 84, 86, 88 and 90 are reversed in position.

Referring to FIGS. 10–15, the apparatus is shown which includes the suit 10. The suit is folded along its longitudinal meridian 67 and the arms 44 and 46 are folded back on the outside of the folded garment. The garment is then rolled into a package. The rolled package 92 is placed within an evacuable sheath 94 of flexible material. The sheath is closed at one end 96 and open at the other end 98. A valve stem 100 provides access to a vacuum pump. Before the sheath 94 is evacuated, it is sealed, for example by heat sealing to provide a seal strip 102. The sheath may be made of plastic, for example polyethylene material similar to that used for food containers. The vaccuum is then applied until the air is drawn out of the sheath. Because the skin 18 has a permeable and compressible core 32 and permeable or breathable sheets 34 and 36, it may be compressed to very small size. A suit sufficient to hold an adult may be compressed into a cylinder three inches in diameter and fifteen inches long. After compression, a valve cap 104 is placed on the stem 100. Alternatively, the stem may be folded into closed position and held closed by a bond. The entire unit is placed into a cylindrical container 106 having an end flap 108. The flap may be closed as with a snap fastener 110. The size of the package is sufficiently small so that several packages can be placed under the seat(s) of an automobile to provide protection for all passengers, much like life preservers in boats.

When conditions require hypothermia protection, the user takes suit out of package 92, breaks the seal 102, removes the suit 10 and unrolls it allowing the suit to expand naturally. The suit has graphics (not shown) indicating the right hand and left hand sides and the front and back as well as instructions for its use. The user easily slips into the suit through the entry flap 38. The user then pulls the hood over his or her head and secures all openings using the Velcro closures. If mobility is desired, the mobility flap 24 may be pulled down and folded over to back of suit 88 and the user's legs extended through the bottom opening 22. Similarly, hand access may be obtained by opening the flaps 64 and exiting through the slots 62.

From the foregoing description it will be apparent that there has been provided improved protective apparatus, especially adaptive for protection of a user against hypothermia, which apparatus may easily be collapsed by compression into a small package for storage. Variations and modifications of the herein described apparatus within the scope of the invention will undoubtedly suggest themselves to those skilled in the art. Accordingly, the foregoing description should be taken as illustrative and not in a limiting sense.

I claim:

1. An integral garment having a skin comprising a layer of open-cell foam material sandwiched between sheets of puncture-resistant and moisture resistant material, wherein;

(a) said skin garment is compressible and air permeable;

(b) said skin of said garment is comprised of a three-layer composite material consisting essentially of a middle layer of said open-cell foam material, a top layer of nonmetallic puncture-resistant and moisture-resistant material, and a bottom layer of nonmetallic puncture-resistant and moisture-resistant material, wherein said middle layer of open-cell foam material is contiguous with both said top layer of puncture-resistant and moisture-resistant material and said bottom layer of puncture-resistant and moisture-resistant material;

(c) said skin defines an envelope for receiving the body of an occupant of said protective garment, wherein said envelope has;

1. a front and a back which extends from a top to a bottom, 2. opposite side edges, 3. an entry flap extending longitudinally along said front,
4. means along said entry flap for closing said envelope,
5. arms extending from opposite sides of said envelope,
6. hand exit slots near the end of said arms on the same side of the envelope as said entry flap,
7. means for closing said hand exit slots,
8. an opening across said bottom of said envelope, and
9. means for closing said opening across said bottom of said envelope.

2. The garment as recited in claim 1, wherein said means for closing said opening across said bottom of said envelope is comprised of tabs of hook and loop material sold under the trade name Velcro.

3. The garment as recited in claim 1, wherein said means for closing said hand exit slots is comprised of tabs of hook and loop material sold under the trade name velcro.

4. The garment as recited in claim 1, wherein said garment is comprised of a hood attached to said top of said garment.

5. The garment as recited in claim 4, wherein said hood has a strip extending around a face opening of said hood which defines a face flap along the base of said face opening.

6. The garment as recited in claim 5, wherein said hood is comprised of closure means on said hood and said face flap.

7. A hypothermia protection apparatus which is comprised of the garment recited in claim 1, and a container providing an interior volume much smaller than the volume occupied by said garment.

8. The apparatus as recited in claim 7, wherein said container is cylindrical in shape.

9. The apparatus as recited in claim 8, wherein said container has a closed end and an open end.

10. The apparatus as recited in claim 9, wherein said container has a flap disposable across said open end for closing said open end.

* * * * *